United States Patent [19]

Baugh

[11] 4,089,412

[45] May 16, 1978

[54] MUSICAL INSTRUMENT REED STORAGE ASSEMBLY

[75] Inventor: Karol Baugh, Schofield, Wis.

[73] Assignee: Impact Industries, Inc., Wausau, Wis.

[21] Appl. No.: 776,629

[22] Filed: Mar. 11, 1977

[51] Int. Cl.[2] ..... C25D 17/00

[52] U.S. Cl. ..... 206/314; 206/805

[58] Field of Search ..... 206/314, 305, 805, 478, 206/479, 481

[56] References Cited

U.S. PATENT DOCUMENTS

| | | | |
|---|---|---|---|
| 1,625,651 | 4/1927 | Gretsch | 206/314 |
| 1,706,063 | 3/1929 | Higgins | 206/314 |
| 1,997,820 | 4/1935 | Gononi | 206/314 |
| 3,393,793 | 7/1968 | Eresman | 206/314 |
| 3,823,814 | 7/1974 | Lum | 206/805 |
| 3,955,656 | 5/1976 | Kashinski | 206/805 |

FOREIGN PATENT DOCUMENTS

| | | | |
|---|---|---|---|
| 633,069 | 10/1927 | France | 206/314 |
| 6,685 of | 1914 | United Kingdom | 206/805 |

*Primary Examiner*—Herbert F. Ross
*Attorney, Agent, or Firm*—Arthur J. Hansmann

[57] ABSTRACT

A musical instrument reed storage assembly including a base piece with a flat surface on each opposite side thereof and with musical instrument reeds with flat surfaces abutting the base piece flat surfaces and with two elastic bands spaced apart and extending over the base pieces and over the reeds for holding the reeds straight and flat on the base piece and with the elastic bands having holes for aeration of the reeds. The base piece has indicia for identifying and sequential use of the reeds and the base piece also has an area which receives pencil or pen writing for identifying the assembly.

4 Claims, 4 Drawing Figures

FIG. 1
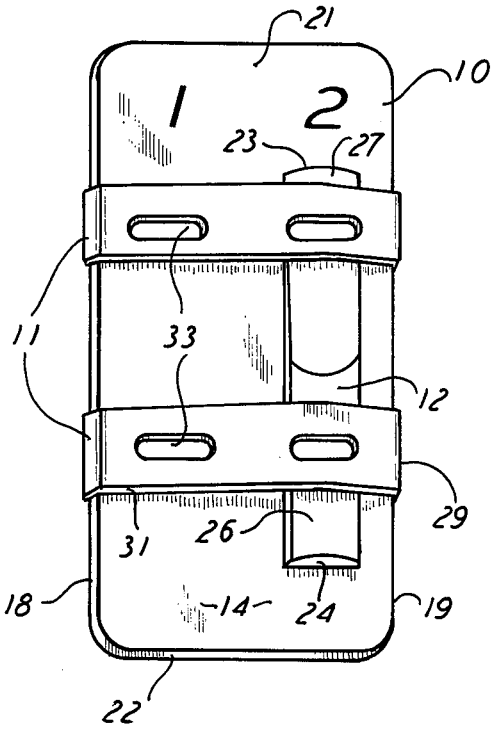
FIG. 2
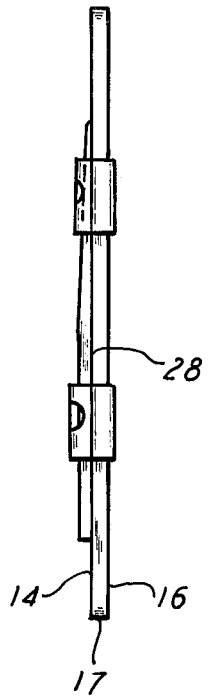
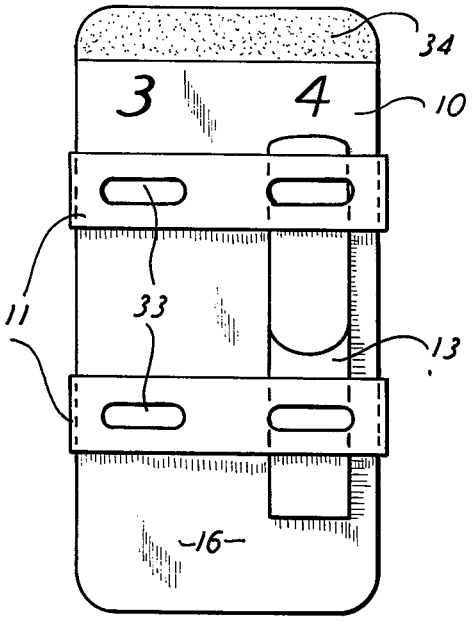
FIG. 3
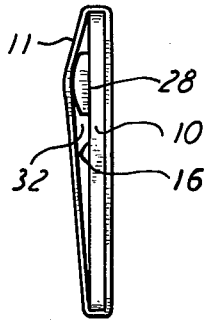
FIG. 4

MUSICAL INSTRUMENT REED STORAGE ASSEMBLY

MUSICAL INSTRUMENT REED STORAGE ASSEMBLY

This invention relates to a musical instrument reed storage assembly, and, more particularly, it relates to an assembly whereby woodwind types of musical instrument reeds are held in a flattened and aerated position for storage and accessibility for use.

BACKGROUND OF THE INVENTION

The use of musical instrument reeds which are made of moisture absorbing fibrous material are prone to becoming excessively moist, due to ordinary use and consequent subjection to saliva. Accordingly, it is preferred that a musician retain several reeds which can be alternated during the course of one sitting of playing, and thus the reed can be utilized without excessive moisture or other objectionable conditions. Further, it is already known that once a reed is wet, even from only ordinary use, then the reed is subject to warping and splintering.

Attempts to resolve the problems of reed moisture and warpage or distortion result in the provision of reed holders which receive a plurality of reeds and which endeavor to hold the reed in aeratable or firm condition. One such example of a reed holder is found in U.S. Pat. No. 2,604,978 wherein a plurality of reeds are held in a holder arranged with pockets for receiving the reeds and with a spring clip which snaps over the thin end of each reed. In that arrangement, the reed holder is commonly made of a contaminable, such as rustable, material of metal or the like, and the pockets actually tend to impair aeration or drying of the reeds, and the spring clips bear down on the reeds in a manner to actually indent or damage the moist reed.

Accordingly, it is a general object of this invention to provide an improved musical instrument reed storage assembly wherein one or more reeds can be held in an open or aeratable condition and with the reed or reeds held in a flat condition so that it can dry in the desired planar or flat configuration.

Still further, the present invention provides the aforesaid type of assembly which is arranged for receiving a plurality of reeds and with the reeds being identified on the base piece of the assembly so that the reeds can be used in sequence and thus the musician can be assured that the longest drying reed or the reed for a certain instrument is to be used. Still further, the base piece of the assembly for this invention is arranged with a surface which receives either pencil or ink writing thereon, and thus the entire assembly can carry indicia, such as the owner's name or the identification of the instrument related with those particular reeds held in the assembly.

Still further, the aforesaid assembly of this invention, is arranged with an elastic band which surrounds a base piece and which extends over the reeds and is of an elastomeric material which will not at all indent, contaminate, or otherwise damage the reed, and the reed can actually be slid under the band or out from under the band for insertion and removal relative to the assembly.

Generally speaking, it will therefore be understood that the assembly as aforesaid is arranged with musical instrument reeds which may be of a cane fiber construction and which must therefore be delicately handled and which should be retained in a fully aerating position and in a completely safe but securely flat condition while drying. In accomplishing these objectives, the assembly includes a base piece which is of a moisture impervious material and which will not become contaminated but which in and of itself can be washed, and thus a firm plastic material is recommended and utilized herein, and, further, the elastic band holding the reed in the flattened position on the base piece has aerating openings and actually will be spaced off the base piece, by virture of the reed being inserted between the band and the base piece, and thus full aeration of the reed is assured while the reed is also being held in a firm and secure flattened position, as desired.

In summary, and in addition to the above, the assembly of this invention has the following characteristics and features:

(1) The assembly will receive and hold several reeds of various sizes.

(2) The assembly protects and straightens the delicate and sensitive reed tips.

(3) The assembly is arranged with one or more holding bands which permit the movable pressure point against the reed to straighten the reed at the points needed and desired.

(4) The assembly permits the reed to naturally air-dry, and thus there are not unpleasant odors or mildew or molding effects.

(5) The assembly includes a numbering or indicia system which permits the musician to alternate reeds or to use them in sequence for most desirable use and for longer reed life.

(6) The assembly has a writable area for autographing by each musician for easy identification of the assembly.

(7) The assembly assures that a musician will have at least several playable reeds at all times.

(8) The assembly has its base piece made of heat-resistant plastic, preferrably, and it is easily cleaned.

The aforesaid enumerated points are summaries of the previously-mentioned features and characteristics and are some additions thereto but are not necessarily all inclusive.

Other objects and advantages will become apparent upon reading the following description in light of the accompanying drawings.

BRIEF DESCRIPTION OF THE DRAWINGS

FIG. 1 is a front perspective view of a preferred embodiment of this invention and showing only one read held therein in the number "2" position.

FIG. 2 is a side elevational view of the assembly shown in FIG. 1.

FIG. 3 is a rear elevational view of the assembly shown in FIG. 1, and with another reed shown in the number "4" position.

FIG. 4 is a bottom plan view of the assembly shown in FIG. 3.

DETAILED DESCRIPTION OF THE PREFERRED EMBODIMENT

The assembly of this invention includes the base piece 10, one or more elastic bands 11, and one or more musical instrument reeds 12. The drawings show the assembly with one reed 12 on the identifyable front side of the base piece 10, and with one reed 13 on the identifyable rear side of the base piece 10. The drawings also indicate that there could be two more reeds 12 or 13 held with and included in the assembly as defined herein, and the two additional reeds would be in the numbered positions "1" and "3" in addition to the two shown reeds in the numbered positions "2", in FIG. 1 and "4", in FIG. 3.

The base piece 10 is of a block configuration, and it is of material which is impervious to moisture and which will not rust or otherwise contaminate or damage the reeds which are pressed against the piece 10. As such, plastic material is ideal for making the block 10, and the block is arranged with a flat or planar front face 14 and a flat or planar rear face 16, and it has a relatively small thickness identified at 17 in FIG. 2. Also, the overall width of the piece 10, as seen in FIGS. 1 and 3 and extending between the opposite side edges 18 and 19, is of a dimension sufficient to easily accommodate the width of two reeds 12 and 13 in a side-by-side position, or in the numbers "1" and "2" positions as seen in FIG. 1. Further, the overall length of the piece 10 extending between the top edge 21 and the bottom edge 22 is of a dimension sufficient to fully receive and extend beyond the opposite ends 23 and 24 of any reed, such as the reed 12. Thus the reed 12 is disposed with its longitudinal axis aligned with the longitudinal direction of the block 10, and thus the reed is fully protected and stored as a part of the assembly.

Further, the drawings show that the reeds 12 and 13 are of a conventional construction and configuration, and they are therefore probably of a cane fiber material inherently subject to absorbing moisture and to bend and distort, due to normal usage. Thus the reeds have a relatively thick portion 26, adjacent the end 24 and they have a relatively thin or feathered portion or end 27 adjacent the reed end 23. Further, as seen in FIGS. 2 and 4, the standard reed shown and being discussed has a flat surface designated 28 on what can be termed the bottom surface of the reed. Therefore, the reed flattened surface 28 is disposed in full abutment and planar and flat with the corresponding flat surface 14 or 16 of the base piece 10, as respectively shown in FIGS. 2 and 4.

The assembly, in the embodiment shown herein, also has an elastic band as the outer member thereof and extending snugly and tightly around the base piece 10, and that band is actually shown in the form of the two bands 11 in these drawings. Thus, the two bands 11 are spaced apart along the length of the base piece 10, and the bands are of an elastomeric material, such as rubber, and they are of an overall endless girth which causes the bands to be slightly stretched and snug in the extents thereof on the base piece 10 alone and without the reeds in the assembled position shown. That is, the bands 11 have a girth which causes them to be tight with the base piece 10, but the bands can of course be positioned relative to the length of the base piece 10 and thus the locations at which the bands 11 abut and bear down upon the respective length portions of the respective reeds 12 and 13 can be controlled and adjusted. That is, if one wanted to bear down on the very tip of the reed 12 as seen in FIG. 1, then the upper band 11 would be moved slightly upwardly to be in the position over or closer to the very end 23 of the reed 12. Likewise, the lower band 11 can be slid up and down on the block 10 and over the reed 12 for positioning that band and thus applying the pressure points or pressure surface relative to the reed 12, as needed and desired for purposes of aerating and flattening and avoiding warpage of the reed 12.

It will be further noted that the width of the bands 11, as identified by the line designated 29 in FIG. 1, is substantially more than the thickness of the bands 11, as identified by the reference numeral 31 in FIG. 1. As such, the bands 11 provide sufficient bearing surface over the respective reeds held thereunder, due to the significant and relatively large band width 29, and it can also be noticed that the total widths 29 of the two bands 11 is less than half the length of either reed 12 or 13, so that proper pressure surface is attained while proper aeration is also achieved. Further, it will be seen in FIGS. 1 and 4 that the thickness of the reeds 12 and 13 cause the bands 11 to be lifted off the respective flat surfaces 14 and 16 of the base piece 10, as shown by the space designated 32 in FIG. 4, and thus the reeds are subjected to optimum aeration, and the bands 11 do not trap moisture underneath themselves and against the base piece 10 while there is a reed being held by the bands 11. Also, the bands 11 have elongated aeration openings 33 extending therethrough, and thus the openings 33 further promote circulation and aeration of the reeds. However, while the openings 33 are shown elongated, they promote aeration of the reed held below the bands 11 but the openings do not impede the pressurizing reeds for adequate straightening and also for protecting the reeds from damage due to possible encountering of another object which could tear or chip the reeds.

FIGS. 1 and 3 also show the numbered markers or indicia with the numbers "1" and "2" and "3" and "4" on the upper ends of the respective front side 14 and rear side 16. This permits the user to sequentially use the reeds or to otherwise store and identify the reeds for particular instruments, all to the most advantageous application of the assembly. Further, it will be seen that the four markers mentioned are aligned with the respective openings 33 in the bands 11 and relative to the length of the base member 10 and thus to the length of the respective reeds, and therefore the reeds 12 and 13 will be readily positioned in alignment with the openings 33 when the reeds are aligned with their respective markers or identification numbers, as mentioned and shown.

Also, the base piece 10 has an area designated 34 on the rear surface 16, and that area can be arranged in any conventional manner for receiving pencil or ink writing and thus the user or owner can put in his name or other identifying material, such as the particular instrument with which he might want to use that assembly or any individual reeds thereof.

Accordingly, the assembly is arranged with the several elements described, in a disclosure of a preferred embodiment thereof, and it will be seen and understood that the combined width of the two bands 11 is less than one-half the length of any one reed 12 or 13, and thus sufficient pressure surface is applied to the reed while permitting full aeration thereof in the manner described, such as by exposure of the majority of the surface of the reed 12 or 13 and by having the bands 11 lifted off the base piece 10, as indicated by the space 32 in FIG. 4 and by having the aerating passageways or openings 33 in the bands 11.

What is claimed is:

1. A musical instrument reed storage assembly comprising a base piece of a block configuration and having a flat surface extending across one side of said base piece, a musical instrument reed having a flat surface extending across one complete side thereof and with said reed disposed on said base piece with the said flat surfaces in abutment with each other, and an elastic band of an endless girth removably extending fully around said base piece and over said reed and across said flat surface of said bass piece, said band being of a free-body girth length to stretch when extending around said base piece and over said reed and being of length to have said elastic band snug on said base piece and said reed, and thereby press said reed flat against said flat surface of said base piece, and said elastic band being of a width sufficient to extend into contact along the length of said reed for a distance which is at least several times the thickness of said band, said band has at least one opening extending through said thickness and extending over said reed for aerating said reed while on said base piece.

2. The musical instrument reed storage assembly as claimed in claim 1, including a reed positioning marker on said base piece for alignment of said reed on said base piece flat surface, and said band opening being aligned with said marker relative to the position of said reed on said base piece, for assuring positioning of said reed across said opening for the aeration of said reed while on said base piece.

3. The musical instrument reed storage assembly as claimed in claim 2, including two of said bands disposed at respective opposite ends of said reed, and with each said opening of both said two bands being respectively aligned with said marker and said reed, for assuring the positioning of said reed across both said openings for the aeration of said reed while on said base piece.

4. The musical instrument reed storage assembly as claimed in claim 3, including more than two of said reeds and a location marker for each said reed, and two opposite sides of said base piece each have a flat surface, and said markers being on both said base piece flat surfaces and being indicia indicative of sequential use of said reeds.

* * * * *